United States Patent [19]

Prior

[11] 4,121,814

[45] Oct. 24, 1978

[54] SAWBUCK

[76] Inventor: Herbert E. Prior, 6786 Barbara Dr., Sebastopol, Calif. 95472

[21] Appl. No.: 873,556

[22] Filed: Jan. 30, 1978

[51] Int. Cl.[2] ..... B25B 1/20

[52] U.S. Cl. ..... 269/98; 269/296; 269/321 N

[58] Field of Search ..... 182/181–186, 182/151, 224–227; 144/286 R, 286 A, 287; 269/1, 321 N, 321 F, 321 S, 289 R, 95, 97, 98, 296

[56] References Cited

U.S. PATENT DOCUMENTS

| | | | |
|---|---|---|---|
| 3,336,999 | 8/1967 | McSwain | 182/151 |
| 4,074,897 | 2/1978 | Behn | 269/321 N |

*Primary Examiner*—Robert C. Watson

*Attorney, Agent, or Firm*—Melvin R. Stidham

[57] ABSTRACT

A sawbuck comprising a pair of V-shaped members of steel plate or the like having toothed log-gripping members welded along the edges thereof. Depending legs welded to each V-shaped member form slip channels of a size to fit snugly over a standard board of nominal 2 inch thickness whereby they may be carried on a two by four beam of a sawhorse.

5 Claims, 2 Drawing Figures

SAWBUCK

BACKGROUND OF THE INVENTION

A conventional sawbuck comprising two pairs of crossed boards, with the pairs being interconnected by a wooden beam merely cradle a generally cylindrical member, such as a log or utility pole while it is being cut or treated, and particularly with a fairly powerful saw there is a great tendency for the log to roll. In addition to the lack of firm gripping capacity, such sawbucks are of limited strength and are cumbersome to handle and transport.

OBJECTS OF THE INVENTION

It is an object of this invention to provide a sawbuck which can grip a cylindrical object, such as a log or utility pole, firmly.

It is a further object of this invention to provide a sawbuck which is convenient and easy to handle.

It is a further object of this invention to provide a sawbuck which is inexpensive and which can be made operative by adaptation of commonly available articles.

Other objects and advantages of this invention will become apparent from the description to follow, particularly when read in conjunction with the accompanying drawings.

SUMMARY OF THE INVENTION

In carrying out this invention, I provide a pair of V-shaped members, preferably made of steel plates formed into a Vee. A channel member formed by depending legs 3 to 4 inches long are welded to the Vee member with the spacing between them substantially equal to the nominal thickness of finished two inch lumber so as to fit snugly over the beam of a sawhorse. Welded along the wedges of the Vee members are inwardly directed tines adapted to penetrate the surface of a cylindrical piece of wood cradled in the Vees for positive gripping thereof.

DESCRIPTION OF A PREFERRED EMBODIMENT

Figure 1:
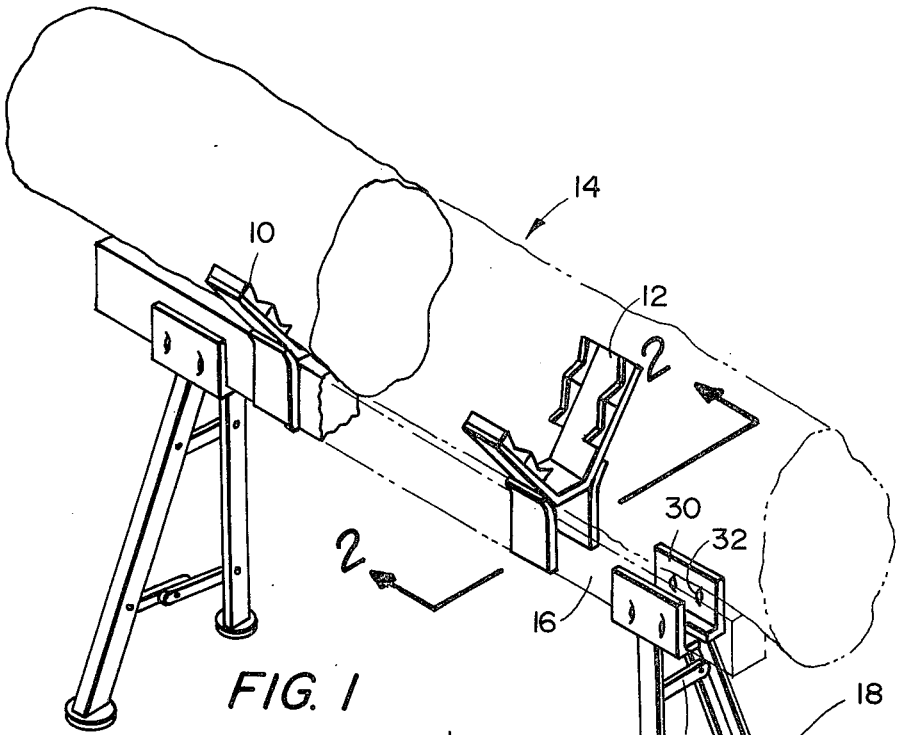
FIG. 1 is a view in perspective of the sawbuck of this invention.
Figure 2:
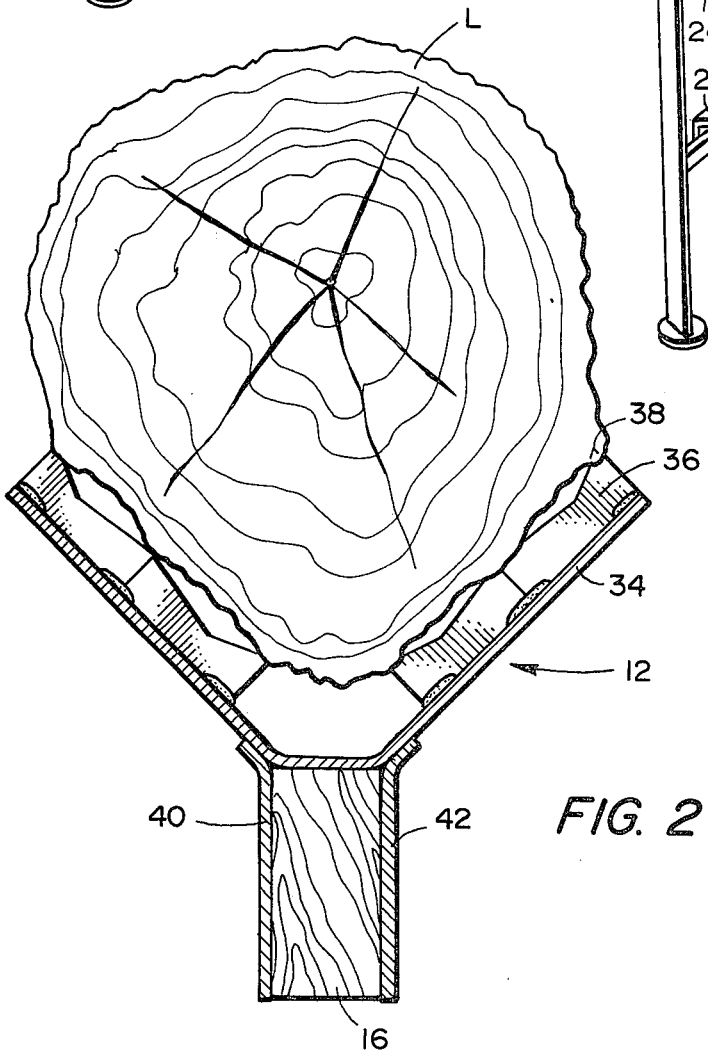
FIG. 2 is a section view taken along line 2 — 2 of FIG. 1.

Referring to the drawing with greater particularity, the identical components 10 and 12 comprising the sawbuck 14 of this invention are adapted for mounting on the conventional two by four beam of a sawhorse.

As shown, the sawhorse beam 16 may be supported on collapsible A-frame supports 18 including angularly disposed legs 20 of steel angles or the like supported on feet 22. The legs are connected together near their tops by a link 24 and toward their bottoms by a toggle link 26 having a stop member 28 to secure them in extended positions. Welded to the top of the legs 20 are horizontally disposed angles 30, which clamp the beam 16 firmly between them and have gripping means 32 which penetrate the sides of the beam 16.

A component 12 of the sawbuck 14 includes a V-shaped member 34 of steel plate or the like along the edges of which are welded strips 36 having barbs or tines 38 which bite into a lot, utility pole or the like L cradled therein and bridging across the V-shaped members 34 of the components 10 and 12.

Welded to the lower sides of the V-shaped member 34 is a pair of spaced steel plates or straddle legs 40 and 42, which are approximately 1½ inches apart so as to snugly and firmly fit over a standard finished two by four 16 with a minimum amount of play. The straddle legs 40 and 42 are wide enough for maximum stability and are preferably approximately 3½ inches in length so as to extend over the full width of the beam 16 to provide firm support.

In use, the sawbuck components 10 and 12 are simply placed over the beam of a conventional, or as shown a collapsible, sawhorse with depending straddle legs 40 and 42 snugly and firmly engaged on the cross-beam. A log, wooden utility pole or the like is then lifted onto the components and the barbs or tines 38 will bite into the surface to prevent the member from rolling or twisting while it is being sawed or otherwise treated.

While this invention has been described in conjunction with a preferred embodiment thereof, it is obvious that modifications and changes therein may be made by those skilled in the art without departing from the spirit and scope of this invention, as defined by the claims appended hereto.

What is claimed as invention is:

1. A device for supporting a generally cylindrical length of wood and gripping it against dislodgement by transverse sawing forces comprising:

a pair of V-shaped members;

each leg of said V-shaped members being of a rolled steel shape;

at least one pointed tooth secured on the inside of each leg of each of said V-shaped members; and a channel member rigidly secured to and depending from each of said V-shaped members;

said channel members being of an inside width approximately equal to the thickness of a standard cut of lumber to fit snugly over the beam of a sawhorse.

2. The device defined by claim 1 wherein:

the legs thereof are at least 3 inches long.

3. The device defined by claim 2 wherein:

the inside width of said channel members is approximately 1½ inches.

4. The device defined by claim 1 wherein:

said V-shaped members comprise strips of steel plate; and inwardly directed tines are secured along the edges of said strips.

5. The device defined by claim 4 including:

narrow steel strips welded along the edges of said plates to extend upwardly therefrom;

said tines being formed in said narrow strips.

* * * * *